US005951265A

United States Patent [19]

Bryant

[11] Patent Number: 5,951,265

[45] Date of Patent: Sep. 14, 1999

[54] FLUID DRIVEN RECIPROCATING ENGINE OR PUMP HAVING OVERCENTER, SNAP-ACTION MECHANICAL VALVE CONTROL

[75] Inventor: Donald C. Bryant, Palm Harbor, Fla.

[73] Assignee: Diemold International, Inc., Fort Myers, Fla.

[21] Appl. No.: 08/999,043

[22] Filed: Dec. 29, 1997

[51] Int. Cl.[6] ..... F04B 35/02

[52] U.S. Cl. ..... 417/403; 417/510; 60/406; 91/346

[58] Field of Search ..... 91/344, 346; 60/403, 60/406; 417/399, 392, 403, 510; 92/161

[56] References Cited

U.S. PATENT DOCUMENTS

| | | | |
|---|---|---|---|
| 995,900 | 6/1911 | Plecher et al. | 239/67 |
| 3,744,381 | 7/1973 | Travaglio | 92/161 |
| 4,558,715 | 12/1985 | Walton et al. | 137/99 |
| 4,756,329 | 7/1988 | Cloup | 137/99 |
| 4,905,576 | 3/1990 | Reynolds | 92/128 |
| 5,055,008 | 10/1991 | Daniels et al. | 417/403 |
| 5,234,322 | 8/1993 | Daniels et al. | 417/403 |

*Primary Examiner*—Timothy S. Thorpe
*Assistant Examiner*—David J. Torrente
*Attorney, Agent, or Firm*—William E. Noonan

[57] ABSTRACT

A fluid driven reciprocating engine includes a main body having an inlet for receiving a primary fluid and an outlet for discharging the fluid. A drive piston is sealingly mounted in the main body for reciprocating movement in response to flow of the primary fluid through the body. The drive piston divides the body into first and second chambers. A first valve selectively transmits the primary fluid from the inlet to the first and second chambers and a second valve selectively transmits the primary fluid from the first and second chambers to the outlet. An overcenter linkage mechanism that operably interconnects the drive piston and the first and second valves. A spring attached to the overcenter linkage mechanism responds to reciprocating movement of the drive piston for alternating the first and second valves between a first state, in which the first valve transmits primary fluid from the inlet to just the first chamber and the second valve transmits primary fluid from just the second chamber to the outlet, and a second state, in which the first valve transmits primary fluid from the inlet to just the second chamber and the second valve transmits primary fluid from just the first chamber to the outlet. A plurality of stop members are fixed to the pump body and impacted by the linkage during movement of the drive piston to facilitate operation of the valves. The stop members also act as a failsafe apparatus to fully open the valves in the event of spring failure.

15 Claims, 8 Drawing Sheets

FLUID DRIVEN RECIPROCATING ENGINE OR PUMP HAVING OVERCENTER, SNAP-ACTION MECHANICAL VALVE CONTROL

FIELD OF THE INVENTION

This invention relates to a fluid driven engine and, more particularly, to a proportioning pump wherein a primary fluid drives a reciprocating piston engine to pump and introduce a metered volume of additive fluid to the primary fluid.

BACKGROUND OF THE INVENTION

Proportioning pumps are utilized to deliver a primary fluid, such as water, to livestock, crops or other applications. Typically, the proportioning pump introduces a metered amount of additive liquid, e.g. chlorine, fertilizer or other chemicals, into the primary fluid. Representative proportioning pumps are disclosed, for example, in U.S. Pat. Nos. 5,055,008 and 5,234,322.

Proportioning pumps of the prior art do not exhibit optimal efficiency. During operation of the pump, a pressure differential is created on opposite sides of the pump's main driving piston. This pressure differential holds the pump valves closed against their respective valve seats. Accordingly, known proportioning valves employ an overcenter linkage and attached spring mechanism that overcomes the pressure differential by lifting the valves from their respective seals and causing them to reverse position as the piston translates within the pump. In instances where the primary fluid is flowing rapidly and the pressure differential is great, a substantial spring tension is usually required to operate the valves. However, the pressure differential and spring tension tend to oppose one another. The stronger the tension spring that is used, the greater will be the pressure differential needed to operate the spring. This differential must be sufficiently great to drive the piston, pump additive fluid, overcome friction and overcome the force of the tension spring acting on the valves. Accordingly, in many cases the fluid flow and pressure differential must be increased to operate the tension spring and overcenter linkage. This is undesirable in applications where a less forceful fluid flow is required. Unfortunately, most known proportioning pumps still tend to employ large, relatively inefficient tension springs and pressure differentials.

Known proportioning pumps also continue to exhibit problems with tension spring failure. When the spring breaks or otherwise fails, the valves can no longer reverse position and the piston will cease pumping. This can have disastrous consequences for livestock or crops. The above-referenced patents disclose various systems which continue to provide primary fluid in the event of spring failure. However, those systems employ mechanisms, such as bypass valves and pivoting linkages, that are themselves potentially subject to failure. A simpler, more reliable fail-safe system for insuring uninterrupted fluid flow is required.

The typically high pressure differential employed by most proportioning pumps can also create problems with the secondary piston that is used to pump the additive fluid into the primary fluid. This piston is typically enclosed in an additive pump body that is attached to the main pump body. High fluid pressures within the pump body can cause the extension to be inadvertently dislodged. In particular, if a person using the pump attempts to remove the additive pump body when the device is under high pressure, the additive pump body may suddenly or violently separate from the main body and present the risk of injury to that person.

Many types of machines, in addition to proportioning pumps, employ a reciprocating piston engine to drive the mechanism. Conventional engines driven by volatile fossil fuels are energy inefficient and present a risk of explosion.

SUMMARY OF INVENTION

Accordingly, it is an object of the present invention to provide a fluid driven reciprocating engine that overcomes the above-described difficulties and represents a significant improvement, particularly when used in a proportioning pump.

It is a further object of this invention to provide a fluid driven engine that operates much more efficiently than the engines used in existing pumps and which does not require large tension springs or the use of high pressure differentials.

It is a further object of this invention to provide a failsafe proportioning pump, which permits primary fluid to be pumped even in the event of tension spring failure.

It is a further object of this invention to provide a fluid driven engine for a proportioning pump, which employs an improved manner of interlocking the additive pump body to the main pump body.

It is a further object of this invention to provide a proportioning pump, wherein it is virtually impossible for a person to separate the additive pump body from the main body when the pump is under high fluid pressure so that the risk of the additive pump body violently dislodging from the main body and injuring that person is significantly reduced.

It is a further object of this invention to provide a fluid driven engine that may be used to effectively and efficiently operate a wide variety of machinery.

It is a further object of this invention to provide a fluid driven engine that is extremely energy efficient and which virtually eliminates the risk of explosion.

This invention results from a realization that a much more efficient fluid driven engine, utilizing smaller pressure differentials and smaller, less costly springs may be achieved by employing stops, cams or some other type of impacting structure fixedly mounted within the engine body, which impact the linkage mechanism to unseat the valves just before the valves are reversed by the spring. This greatly facilitates reversal of the valves so that significantly reduced and more efficient spring force and pressure differential may be used.

This invention results at least partly from the further realization that many types of mechanisms will use less energy and operate without the risk of explosion if they employ a reciprocating piston engine that is driven by a relatively non-volatile fluid such as water or air. Such an engine may be used advantageously in both proportioning pumps, as discussed above, and a wide variety of other machines.

This invention features a reciprocating engine that is driven by a primary fluid. The engine includes a main body having inlet means for receiving the primary fluid and outlet means for discharging the primary fluid. A drive piston is sealingly mounted in the main body for reciprocating movement in response to flow of the primary fluid through the pump body. The drive piston divides the main body into first and second chambers. There are first valve means for selectively transmitting the primary fluid from the inlet into the first and second chambers. Second valve means selectively transmit the primary fluid from the first and second chambers to the outlet. There are means for operably interconnecting the drive piston and the first and second valve means, including an ovecenter linkage mechanism and spring means attached to the linkage mechanism and responsive to reciprocating movement of the drive piston for alternating the first and second valve means between a first state, wherein the first valve means transmits fluid from the inlet to just the first chamber and the second valve means transmits primary fluid from just the second chamber to the outlet, and a second state, wherein the first valve means transmits primary fluid from the inlet to just the second chamber and the second valve means transmits primary fluid from just the first chamber to the outlet. Means are fixedly mounted to the main body for impacting the overcenter linkage mechanism during movement of the drive piston to initiate and facilitate alternation of the first and second valve means between the first and second states. The impacting means are also responsive to failure of the spring for constraining the overcenter linkage mechanism to hold the first and second valve means in a third, fully open state wherein fluid is transmitted through the first valve means from the inlet simultaneously into the first and second chambers and through the second valve means from the first and second chambers simultaneously into the outlet.

In a preferred embodiment, the means for impacting and constraining include a first plurality of stop members fixedly mounted within the pump body, which impact and constrain the linkage mechanism when the piston reaches a predetermined position in a first direction of reciprocating movement. Such means may also include a second plurality of stop members fixedly mounted within the pump body, which impact and constrain the linkage mechanism when the piston reaches a predetermined position in a second direction of reciprocating movement.

The means for operably interconnecting may include a piston rod interconnected between the drive piston and the overcenter linkage mechanism. The means for operably interconnecting may further include an actuator member attached to the first and second valve means. The linkage mechanism may include a central pivot, a first pair of link components connected together by means defining a first pivot and a like second pair of link components linked together by means defining a second pivot. One link component of each pair is connected to the center pivot and the other link component of each pair is connected to the actuator member. The means for operably interconnecting may further include third pivot means for attaching the first pair of link components to the actuator member and a fourth pivot means for attaching the second pair of link components to the actuator member. The spring means may be interconnected to and extend between the first and second pivot means of the linkage. The spring means may include at least one resilient O-ring.

The device may further include an additive pump body attached to the main body and having a third chamber formed therein. A source of additive fluid may be communicably connected to the additive pump body. Conduit means may interconnect the third chamber with the outlet. Additive piston means may be slidably mounted in the third chamber, connected to the drive piston and driven by reciprocating movement of the drive piston for pumping additive fluid from the source to the outlet through the conduit means. Means may be provided for releasably attaching the additive pump body to the main body. The additive pump body may be received through and rotatable in an opening in the main body. Means may be formed on the periphery of the additive pump body and about the opening of the main body for selectively interlocking the additive pump body and the main body. The means for releasably interlocking may include a first lip portion and a first slotted portion formed about the additive pump body and a complementary second lip portion and second slotted portion formed about the opening. The additive pump body is rotated within the opening to selectively align and interengage the first and second lip portions such that the additive pump body and the main body are interlocked, and to selectively align and interengage the first and second lip portions with the second and first slotted portions, respectively, such that the additive pump body is releasable from the main body. The second lip portion may include means defining a pocket. Fluid pressure within the main body urges the first lip portion into the pocket means when the first and second lip portions are aligned, such that rotation of the additive pump body within the pump body is limited. When such fluid pressure is relieved, the additive pump body may be selectively manipulated to remove the lip portion from the pocket. As a result, the additive pump body may be rotated within the opening to align the first and second lip portions with the second and first slotted portions, respectively, and release the additive pump body from the main body. Such disengagement may be required for servicing and maintenance of the device.

DETAILED DESCRIPTION OF PREFERRED EMBODIMENTS

Other objects, features and advantages will occur from the following description of preferred embodiments and the accompanying drawings, in which.

Figure 21:
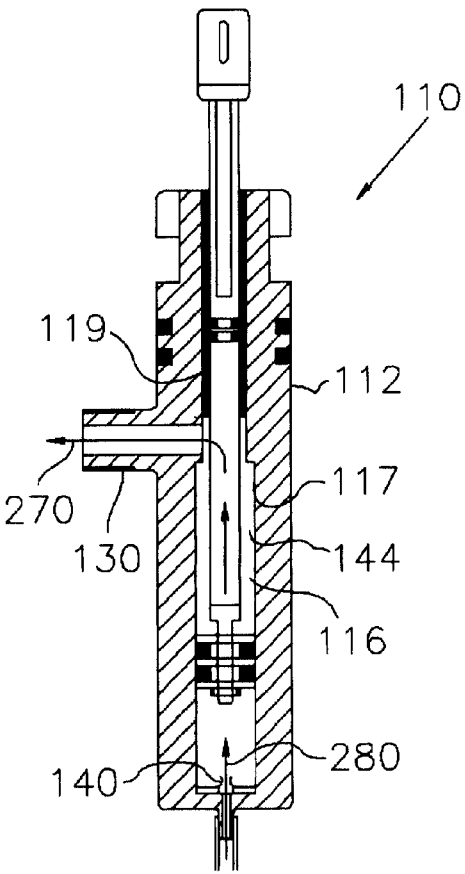
Figure 20:
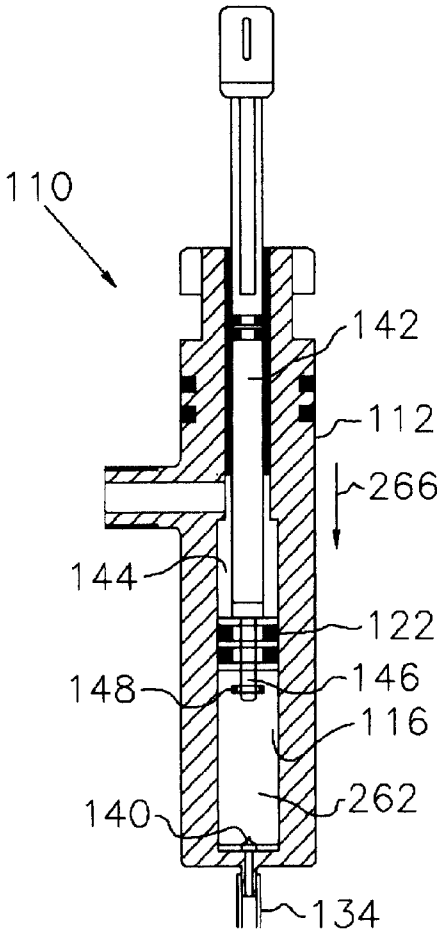
Figure 19:
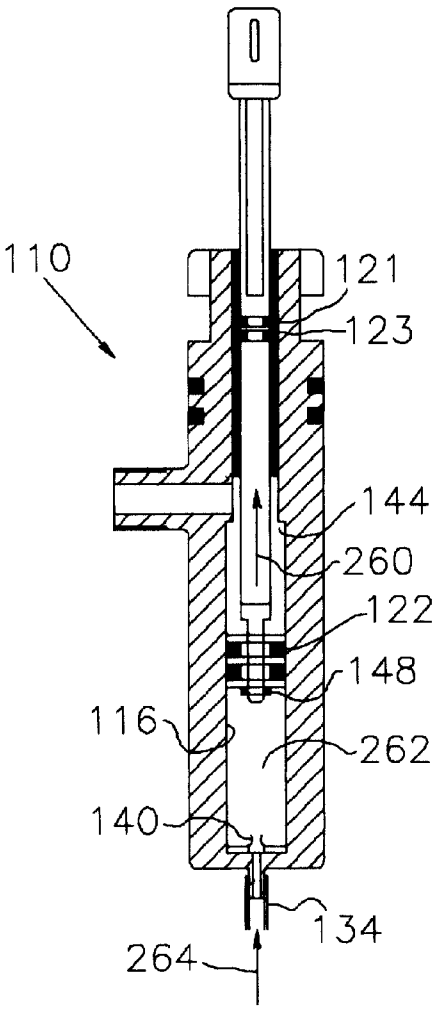
FIG. 19 is an elevational, cross sectional view of the additive fluid pumping assembly with its piston being raised to draw additive fluid into the additive pump body.

FIG. 20 is a view similar to FIG. 19 but with the additive pump piston on a downward stroke, which introduces additive fluid into an upper portion of the additive pump body; and FIG. 21 is a view similar to FIGS. 19 and 20, wherein the additive pump piston is again being drawn upwardly to draw additional additive fluid into a lower portion of the additive pump body and to pump additive fluid in the upper portion of the additive pump body through the conduit toward the outlet of the fluid pump.

Figure 1:
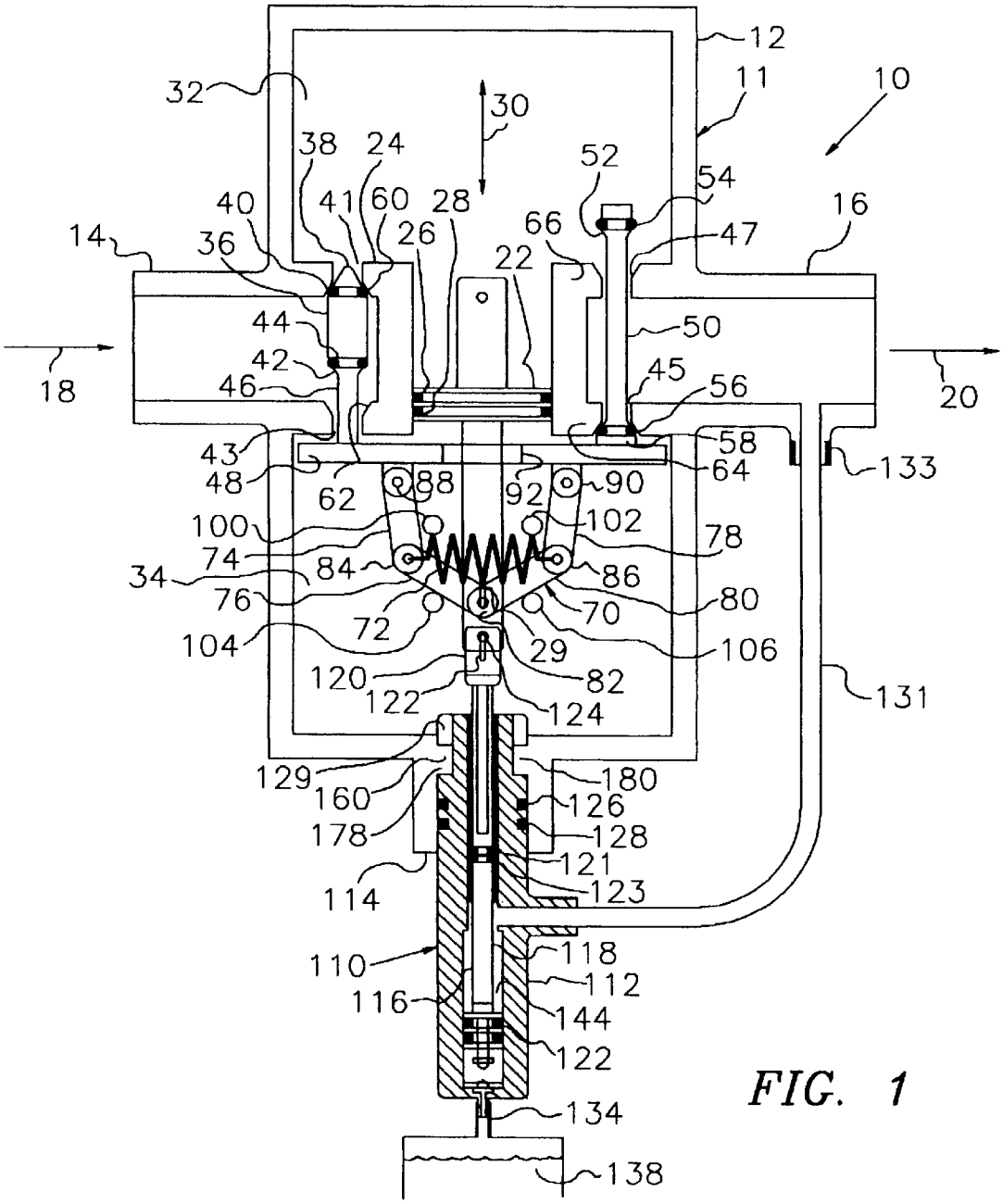
FIG. 1 is an elevational, cross sectional and partly schematic view of a proportioning pump featuring the fluid driven engine of this invention.

There is shown in FIG. 1 a fluid pump 10 that is designed particularly in the form of a proportioning pump. It should be understood that the principles of this invention may be applied to various other types of pumps, although they are particularly beneficial for use in proportioning pumps. This type of pump is designed to provide fluid, such as water, for various applications, including agriculture, livestock and all sorts of irrigation and farming. It should also be understood that the pump is represented, at least partly, in schematic form herein. The particular pieces, parts and components may be constructed in a manner that will be apparent to those skilled in the art.

Pump 10 employs and is powered by a fluid driven engine 11. Although engine 11 is described in the context of a pump herein, it should be appreciated that the engine may also be used effectively to operate a wide variety of other machines.

Engine 11 includes a main housing or body 12 that is composed of a durable plastic or analogous material suitable for use in pumps. Body 12 includes a tubular inlet 14 that is interconnected to a source of primary fluid, which is typically under pressure. The main body also includes a tubular outlet 16 that is connected by appropriate known means to the application in need of primary fluid. Inlet 14 receives the primary fluid, as indicated by arrow 18 and outlet 16 discharges the primary fluid in the manner indicated by arrow 20.

Figure 2:
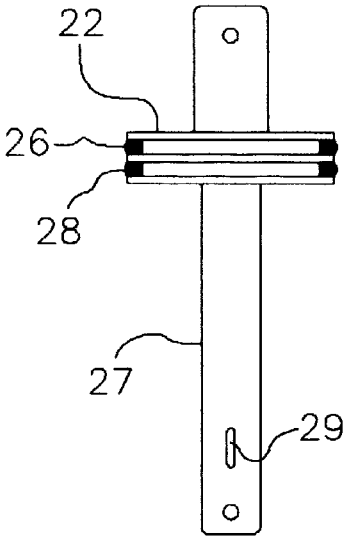
FIG. 2 is an elevational front view of the piston and attached piston rod.

A drive piston 22 is sealingly mounted in main body 12 such that the periphery of piston 22 engages an annular sleeve 24 formed unitarily or otherwise in body 12. A pair of O-rings 26 and 28 (or alternative types and number of seals) are formed peripherally about piston 22 to provide sealing interengagement between the periphery of the piston and sleeve 24. Piston 22 divides body 12 into an upper chamber 32 and a lower chamber 34. As further illustrated in FIG. 2, an elongate piston rod 27 is unitarily interconnected to and extends from piston 22. A longitudinal slot 29 is formed in piston rod 27. This slot cooperates with the overcenter linkage mechanism described below. As will be explained hereinafter, piston 22 and attached piston rod 27 move in a reciprocating manner within main body 12, as indicated by double headed arrow 30 in FIG. 1.

Figure 3:
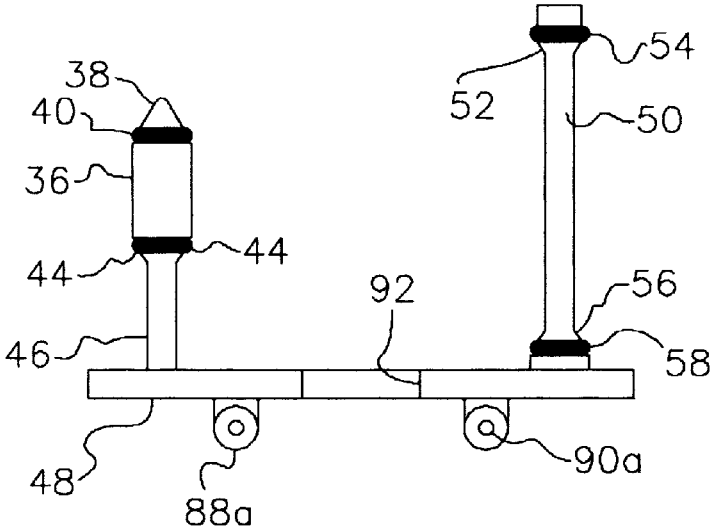
FIG. 3 is an elevational front view of the valve means and the attached valve actuator.

A first valve 36 is operably mounted in inlet 14. Specifically, as shown in FIGS. 1 and 3, valve 36 includes a tapered upper valve seat 38 carrying an O-ring 40 and a tapered lower valve seat 42 carrying an O-ring 44. A valve stem 46 interconnects valve 36 to a generally planar valve actuator assembly 48.

A second valve 50 is likewise operably mounted in outlet 16. Valve 50 includes an upper valve seat 52 carrying an O-ring 54 and a lower valve seat 56 carrying an O-ring 58. The lower end of valve 50 is joined to and extends upwardly from actuator member 48.

Valves 36 and 50 operate, in a manner described more fully below, such that they are alternatable back and forth between first and second states, as indicated by double headed arrow 30 in FIG. 1. The valves are depicted in their first state in FIG. 1. Therein, valve seat 38 of valve 36 engages a tapered shoulder 60 in main body 12. This closes an orifice 41 interconnecting inlet 14 and upper chamber 32. Valve seat 42 is spaced apart from a lower shoulder 62 such that the inlet is communicably connected to lower chamber 34 through an open orifice 43. Likewise, in the first state, valve 50 is positioned such that lower valve seat 56 engages a complementary tapered shoulder 64 in main body 12. This closes orifice 45 between chamber 34 and outlet 16. Upper valve seat 52 is spaced apart from an upper shoulder 66 so that upper chamber 32 is communicably interconnected to outlet 16 through orifice 47.

In the second state, which will be described more fully below, the above described valve positions are reversed. Lower valve seat 42 of valve 36 engages lower shoulder 62 and upper valve seat 38 is spaced apart from upper inlet shoulder 60. As a result, orifice 41 is open, orifice 43 is closed and only upper chamber 32 is communicably connected to inlet 14. By the same token, in the second state, upper valve shoulder 52 engages shoulder 66 while lower seat 56 is spaced apart from shoulder 64. As a result, orifice 45 is open, orifice 47 is closed and only chamber 34 is communicably connected to outlet 16.

Figure 4:
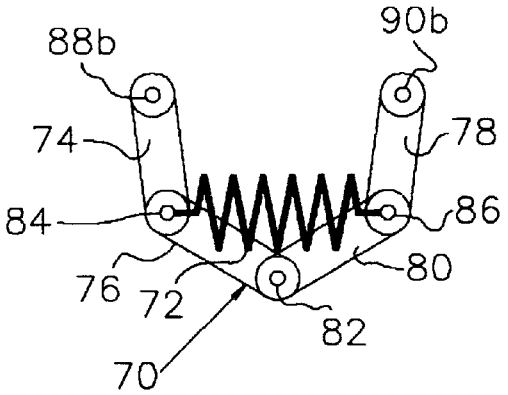
FIG. 4 is an elevational front view of the overcenter linkage mechanism and the attached tension spring.

Means are provided for operably interconnecting drive piston 22 to valves 36 and 50. Such means include an overcenter linkage mechanism 70, FIGS. 1 and 4, and an attached tension spring 72. Overcenter linkage mechanism 70 includes a first pair of link components 74 and 76 and a similar second pair of link components 78 and 80, which are connected to components 74 and 76 by a central pivot 82. Link components 74 and 76 are themselves interconnected by a first pivot 84. Link components 78 and 80 are likewise interconnected by a second pivot 86. A third pivot 88, FIG. 1, comprising respective pivot parts 88*a* and 88*b*, FIGS. 3 and 4, interconnects link component 74 to actuator member 48. A fourth link component 90, comprising respective pivot parts 90*a* and 90*b*, FIGS. 3 and 4, likewise interconnects link component 78 and actuator member 48.

As shown in FIG. 1, piston rod 27 is slidably interconnected to overcenter linkage mechanism 70. In particular, pivot 82 is received through longitudinal slot 29 in rod 27. The piston rod extends through a central opening 92 in actuator member 48 and is fixedly secured to piston 22 above the actuator member.

Spring 72 is interconnected to and extends between pivots 84 and 86 of linkage mechanism 70. Spring 72 is depicted in a generally schematic fashion. It should be understood, however, that the spring will typically comprise a resilient O-ring that is wrapped about a pair of pulleys axially attached to the pivots 84 and 86, respectively. It should also be understood that, although only a single overcenter linkage mechanism and spring are depicted, in various embodiments of this invention, a pair of linkage mechanisms and respective springs may be utilized. Each such apparatus is typically provided on a respective side of piston rod 27. Nonetheless, embodiments that employ a pair of overcenter linkage mechanisms and attached springs operate in a manner analogous to that described herein.

As illustrated in FIG. 1, a first pair of stop elements 100 and 102 are fixedly secured to main body 12 generally above linkage mechanism 70. An analogous second pair of stop elements 104 and 106 are likewise fixedly secured to body 12 generally below the overcenter linkage mechanism. These stop elements operate in a manner described more fully below to achieve a number of advantageous results relating to operation of pump 10. Various other numbers and types of fixed elements may be employed.

Figure 5:
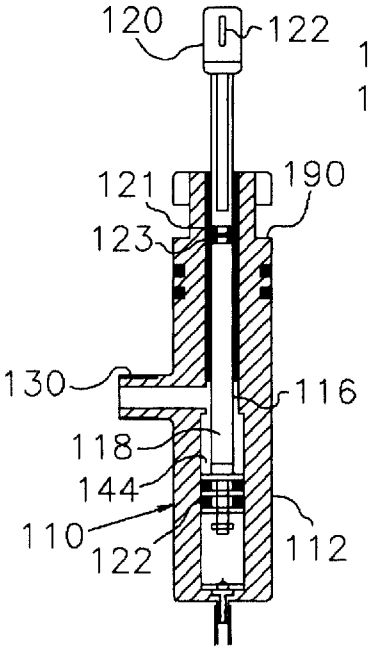
FIG. 5 is an elevational view of the lower proportioning pump assembly.

The proportioning pump further includes an additive fluid pump assembly 110, depicted in FIGS. 1 and 5. Pump assembly 110 includes an additive pump body 112 that is received in a central opening 114 formed through the lower end of main body 12. Additive pump body 112 includes a central chamber 116 that slidably receives an additive pump piston 118. This piston is attached at its upper end to the lower end of piston rod 27. In particular, a bracket 120 connected to the upper end of piston 118 includes a longitudinal slot 122. This slot receives a pin 124, FIG. 1, which secures the additive piston assembly 118 to upper piston rod 27. As a result, piston assembly 118 reciprocates longitudinally within chamber 116 of pump body 112. Chamber 116 includes a lower, relatively large diameter portion 117 and an upper, relatively narrow diameter portion 119, FIG. 6.

Figure 6:
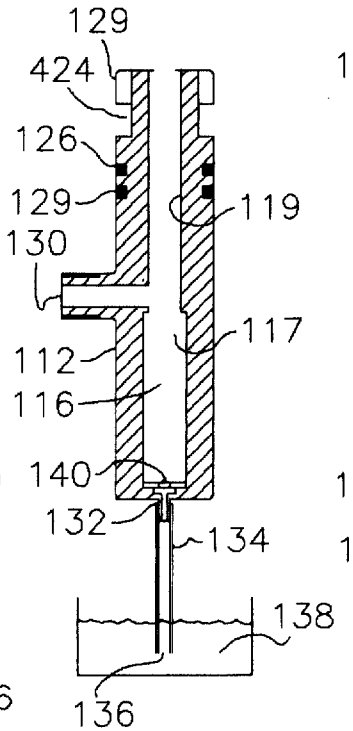
FIG. 6 is an elevational, cross sectional view of the additive pump body.

The additive pump body, shown alone in FIG. 6, includes a first lip portion 129 and an upper recess 424 that assist in releasably interlocking the additive pump body 112 to the main body 12. This construction is described more fully below. A pair of O-rings 126 and 128 help to seal body 112 within opening 114 (FIG. 1) of body 12. A transverse discharge port 130 is communicably joined with chamber 116. As best shown in FIG. 1, an elongate conduit 131 communicably interconnects discharge port 130 and a transverse inlet port 133 in outlet 16. The lower end of body 112 includes a cylindrical portion 132 that is communicably attached to an inlet tube 134. The lower open end 136 of tube 134 is positioned in a source 138 of additive fluid. A check valve 140 mounted in body 112 permits additive fluid to be drawn through tube 134 and cylindrical portion 132 into chamber 116, but prevents such fluid from returning to source 138 after it has entered chamber 116.

Figure 7:
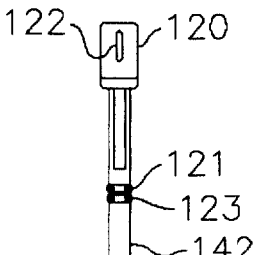
FIG. 7 is an elevational view of the additive pump piston.

Additive fluid piston 118, shown alone in FIG. 7, includes an elongate piston rod 142. Previously described bracket 120 is attached to the upper end of rod 142. A pair of upper O-rings 121 and 123 are carried in respective circumferential grooves formed in rod 142. As further shown in FIGS. 1 and 5, these O-rings help to seal piston rod 142 within chamber 116 and separate chamber 116 from chamber 34. A piston ring 122 is carried proximate the lower end of rod 142. A second pair of O-rings 125 and 127 are carried by respective grooves in ring 122. These O-rings also sealingly engage the walls of chamber 116 and form a generally cylindrical space 144 within chamber 116, between upper O-rings 121, 123 and lower piston ring 122.

The lower end of piston rod 142 includes a reduced diameter portion 146 that is slidably received within a central opening in piston ring 122. A check valve 148 comprising an O-ring is carried by reduced diameter portion 146. This check valve operates in conjunction with additive pump assembly 110 in a manner that will be described more fully below.

Figure 10:
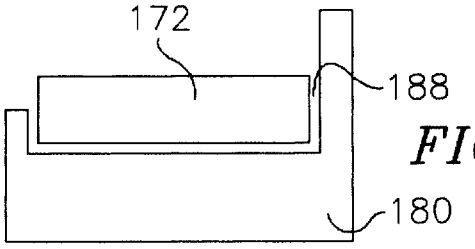
FIG. 10 is an elevational view of one of the lips of the additive pump body received in a pocket of the main body.
Figure 9:
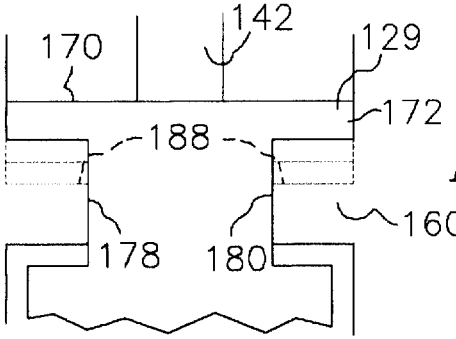
FIG. 9 is a cross sectional view taken along line 9—9 of FIG. 8.
Figure 8:
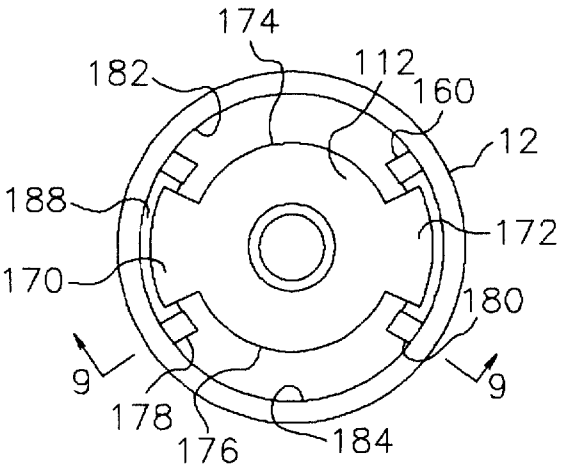
FIG. 8 is a top, cross sectional view of the apparatus for interlocking the main body and the additive pump body.

Pump body 112 is secured to main body 12 in a manner shown in FIG. 1 and, more particularly, in FIGS. 8, 9 and 10. Main body 12 includes a second lip portion 160 that interengages first lip portion 129 of body 112 such that the additive pump body is interlocked to the main body. As shown in FIGS. 8 and 9, lip portion 129 includes a pair of generally dovetail shaped lip segments 170 and 172. These lip segments alternate with a pair of slotted segments 174 and 176. Second lip portion 160 of main body 12 includes a pair of spaced apart lip portions 178 and 180. These lip portions alternate with second slotted portions 182 and 184 formed about opening 114. As best represented by lip portion 180 in FIG. 10, each of the second lip portions 178 and 180 includes a pocket 188 that receives a respective lip segment of pump body 112. In particular, pocket 188 of lip portion 180 receives lip segment 172. Similarly, the pocket of lip portion 178 receives lip segment 170 (FIG. 8). As a result, body 112 is interlocked with body 12. When primary fluid pressure greater than atmospheric pressure is applied to the engine, the additive pump body and attached lips are pushed downwardly relative to the main body by the pressure in chamber 34. The pocketed lip portions 178 and 180 receive the lip segments 170 and 172, respectively. This interengagement prevents the additive pump body 112 from rotating relative to the main body. As a result, the pump body cannot be turned and dislodged from the main body when the unit is under high pressure.

To release additive pump body 112 from main body 12, the fluid pressure in chamber 34 is reduced to approximately atmospheric pressure. The additive pump body is then able to be manually pushed upwardly against the main body. A slight clearance is provided between shoulder 190, FIG. 5, of body 112 and the bottom of lip portions 178 and 180 of body 12. This permits body 112 to move upwardly. By pushing upwardly on the additive pump body, the lip segments 170 and 172 are lifted out of their respective pockets 188. The additive pump body is then rotated within main body opening 114 until lip segments 170 and 172 are aligned with slotted portions 182 and 184, respectively in main body 12. The additive pump body may be pulled longitudinally outwardly and detached from main body 12.

A typical person can not readily remove the additive pump body until the fluid pressure in chamber 34 is reduced to a safe level, e.g., approximately atmospheric pressure. Only under such conditions can lip segments 170, 172 be pushed out of their respective pockets 188 so that main body 112 can be turned and detached. Sudden or violent dislodgment of the additive pump body and potential injury to the user are thereby avoided.

Engine 11 and fluid pump 10 normally operate as illustrated in FIGS. 1 and 11–15. In FIGS. 11–15, the lower additive fluid pump assembly is totally omitted for illustrative purposes. It should be understood that the operating principles of the fluid driven engine apply to various types of fluid pumps, which may, but do not necessarily, utilize an attached additive fluid pump assembly. It should also be understood that the primary fluid driving cycle as described in the following sequence is illustrative only. The actual operational sequence may commence at or between any of the particular points illustrated in FIGS. 1 and 11–15.

As shown in FIG. 1, primary fluid under pressure enters inlet 14 in the direction of arrow 18. Piston 22 is positioned proximate the bottom of its downstroke and spring 72 has pulled overcenter linkage mechanism 70 into a collapsed condition that causes valve 36 to close chamber 32 and open chamber 34. At the same time, the linkage mechanism urges valve 50 to open chamber 32 and close chamber 34 to outlet 16. Fluid flows from inlet 14 into lower chamber 34 through open orifice 43. As a result, fluid pressure gradually builds in chamber 34. This pressure urges piston 22 upwardly within main body 12. If fluid is already in upper chamber 32, the fluid pressure in this chamber increases and primary fluid in the upper chamber is discharged through orifice 47 into outlet 16. The primary fluid is then delivered in the direction of arrow 20 to the requisite use.

Figure 11:
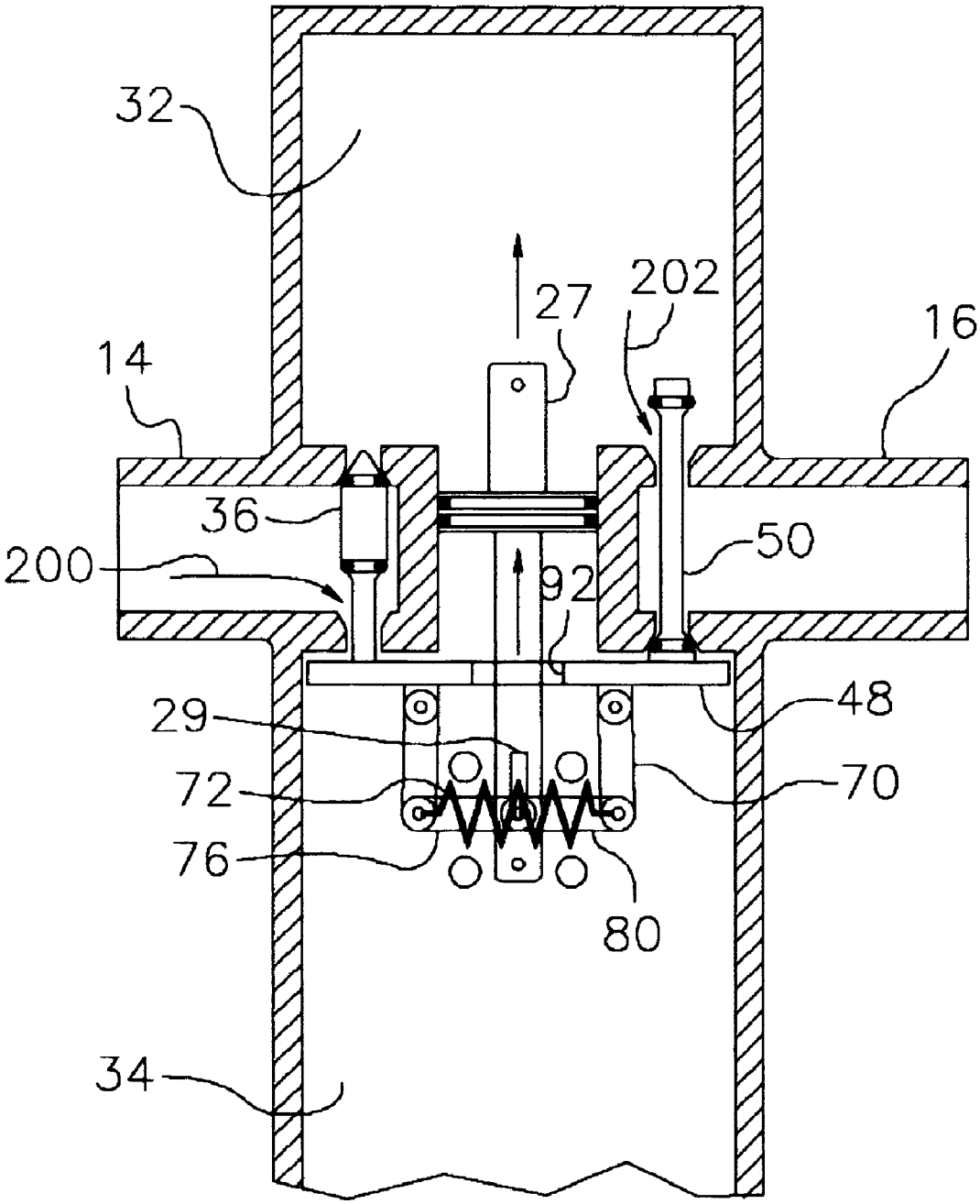
FIG. 11 is an elevational, cross sectional view of the fluid driven engine with the piston in an upstroke position and the linkage passing its centerline position.

As piston 22 travels in the upstroke direction, FIG. 11, the lower end of slot 29 engages the center pivot of linkage mechanism 70 and causes links 76 and 80 to spread apart in the manner shown. This stretches attached spring 72, which is shown in its maximum tensioned condition in FIG. 11. At that point, the linkage mechanism 70 is pulled by piston rod 27 past the centerline position of the linkage. This is the position where the linkage mechanism is spread apart or opened to its maximum degree and link components 76 and 80 are generally aligned. Primary fluid continues to be drawn through inlet 14 and past valve 36 into lower chamber 34, as indicated by arrow 200. At the same time, the increasing pressure in upper chamber 32 urges fluid out of that chamber and into outlet 16 past valve 50, in the manner illustrated by arrow 202. The volume of primary fluid introduced into chamber 34 from inlet 14 approximately equals the volume of primary fluid discharged from chamber 32 into outlet 16.

Figure 12:
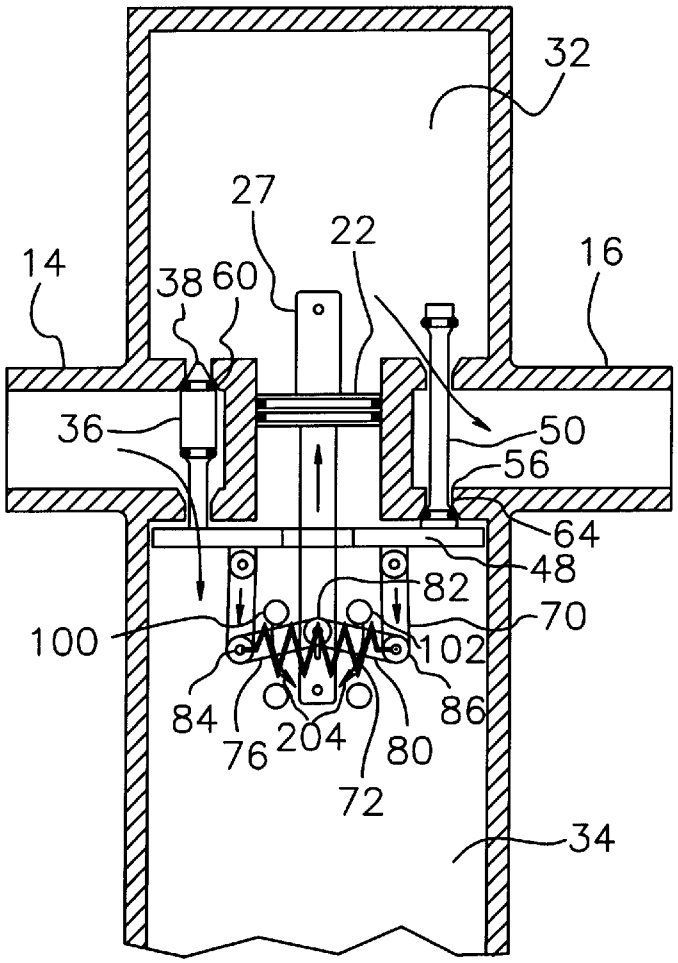
FIG. 12 is a view similar to FIG. 11 after the linkage has been moved past its centerline position and just as the linkage mechanism has impacted one pair of the stop members.
Figure 15:
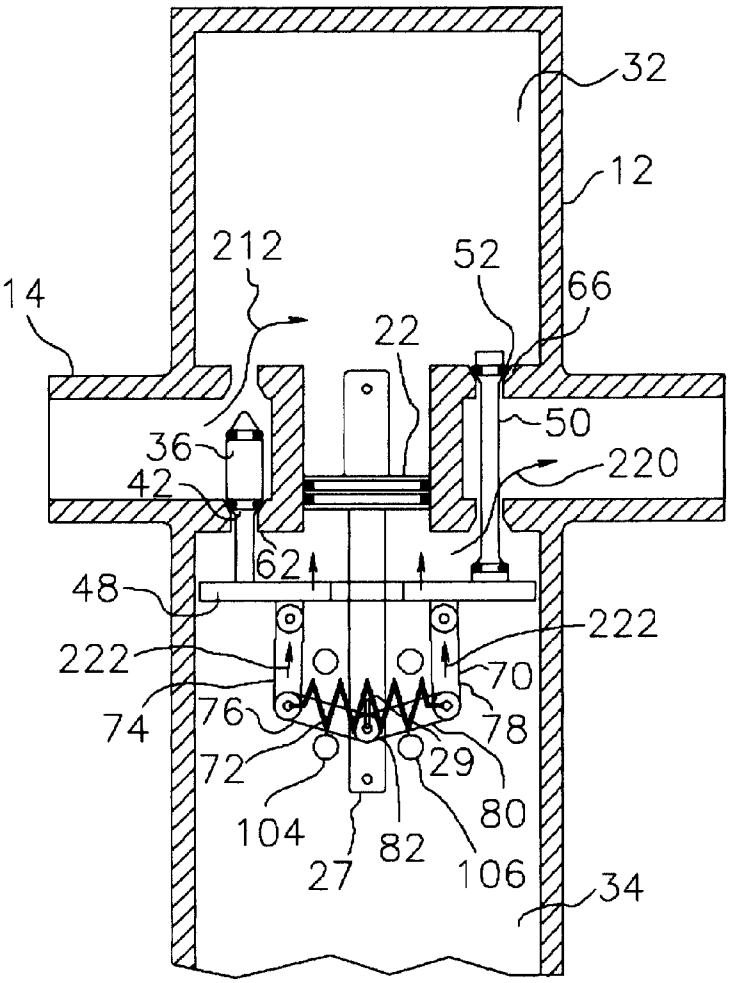
FIG. 15 is an elevational, cross sectional and partly schematic view of the engine with the linkage mechanism impacting the second set of stop members, which cause the valves to slightly unseat so that the spring reverses the valves into the position shown in FIG. 1.

As shown in FIG. 12, when piston 22 approaches the top of its upstroke, and linkage mechanism 70 is pulled past the centerline position, spring 72 causes the linkage mechanism to collapse. In other words, link components 76 and 80 fold and pivots 84 and 86 are pulled together in the manner illustrated by arrows 204. Linkage mechanism 70 collapses suddenly. Center pivot 82 immediately slides toward the upper end of piston rod slot 29. Links 76 and 80 strike and are impacted by fixed stop members 100 and 102, respectively. The force of this impact is transmitted through linkage mechanism 70 and actuator member 48 to valves 36 and 50. As a result, valve seat 38 of valve 36 is jarred loose from its interengaged shoulder 60 and, similarly, valve seat 56 of valve 50 is jarred lose from its interengaged shoulder 64. Essentially, the impact force of the linkage mechanism striking the stop members 100 and 102, is transmitted through the linkage, breaks the seals formed by the respective valve seats and separates valves 36 and 50 slightly from their previously interengaged pump body shoulders. As a result, the pressure differential between the primary fluid in lower chamber 34 and upper chamber 32 is reduced somewhat. This initiates and facilitates reversal or alternation of the valves from their first state to their second state.

Figure 13:
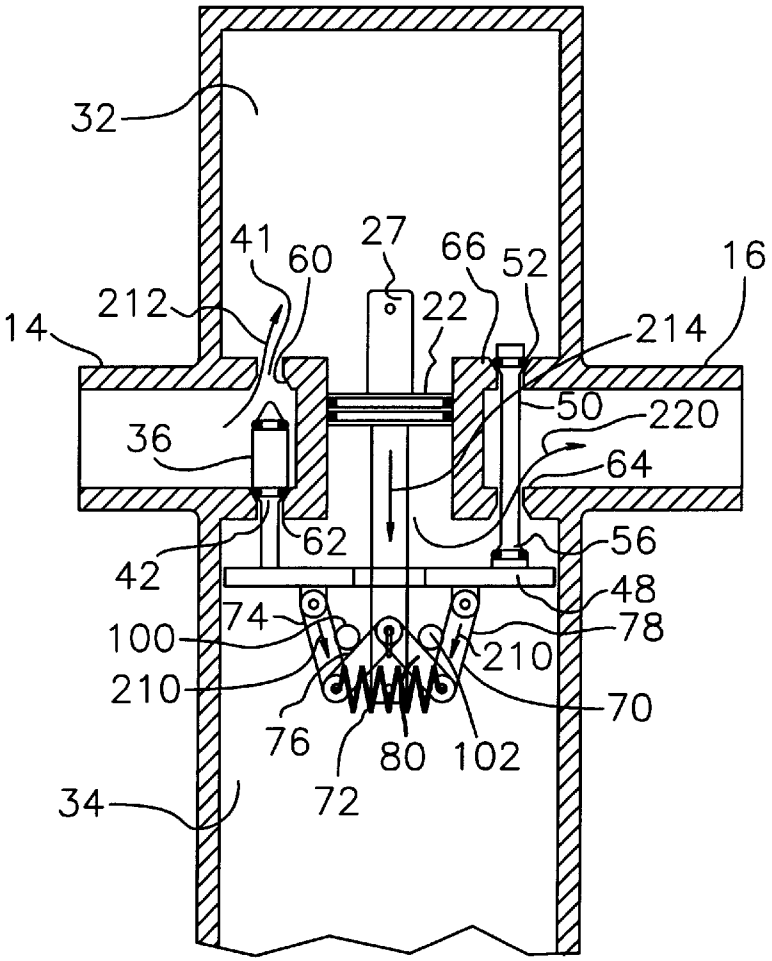
FIG. 13 is an elevational, cross sectional and partly schematic view of the engine after the spring has fully collapsed the linkage mechanism such that the valves have reversed position from the state shown in FIGS. 11 and 12.

After striking stop members 100 and 102, linkage mechanism 70 continues to collapse, in the manner shown in FIG. 13. As spring 72 pulls link components 76 and 80 into a relatively folded condition, link components 74 and 78 are pulled downwardly in the direction indicated by arrows 210. This pulls actuator member 48, likewise in a longitudinally downward direction. Because the actuator member receives piston rod 27 through opening 92, the actuator member is allowed to move in a direction opposite to the upwardly translating piston rod. Valves 36 and 50 are pulled downwardly by actuator member 48 such that they are switched from their first state, shown in FIGS. 1, 11 and 12, to their second state, shown in FIG. 13. In the second state, valve seat 42 interengages shoulder 62 so that valve 36 closes lower chamber 34 to inlet 14. At the same time, valve 36 is disengaged from upper shoulder 60 and upper chamber 32 is opened to inlet 14. Primary fluid under pressure thereby enters the upper chamber through orifice 41, in the direction of arrow 212. Likewise, valve 50 is actuated such that valve seat 52 is engaged with shoulder 66 and lower seat 56 is disengaged from shoulder 64. The outlet 16 is now closed to chamber 32 but opened to lower chamber 34. As fluid enters chamber 32 through orifice 41, in the direction of arrow 212, fluid pressure in upper chamber 32 eventually exceeds the pressure in lower chamber 34. This pressure differential causes piston 22 and attached piston rod 27 to reverse direction and travel longitudinally downwardly, as indicated by arrow 214. Fluid pressure then builds in the lower chamber and fluid is discharged through open valve 50 into outlet 16, as indicated by arrow 220.

Figure 14:
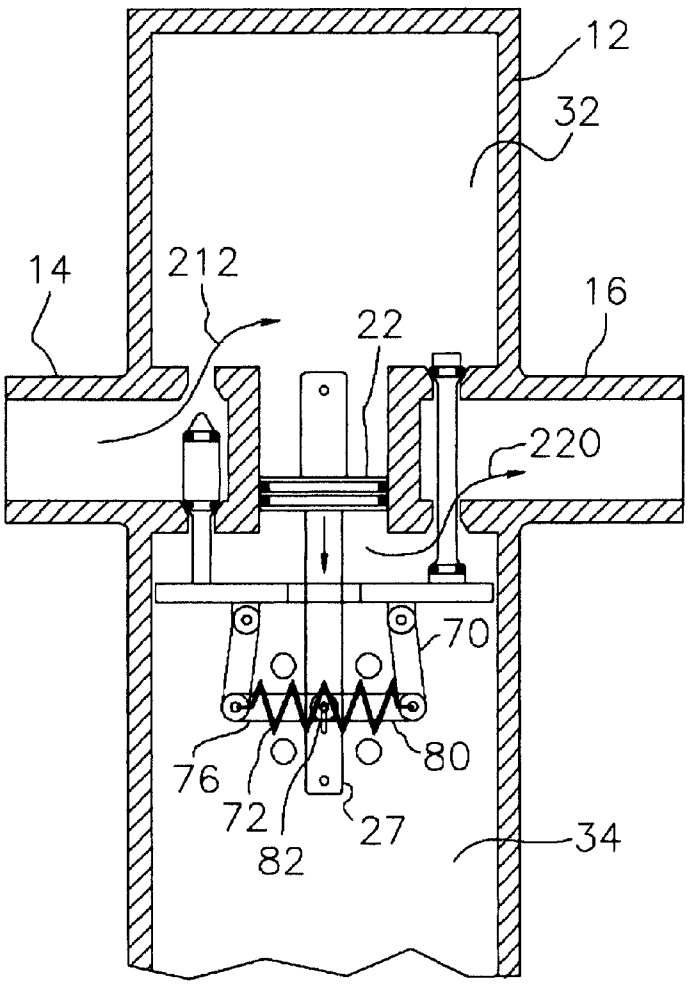
FIG. 14 is an elevational, cross sectional and partly schematic view of the engine with the piston moving in a downstroke direction and the linkage mechanism crossing its centerline position.

Piston 22 continues to translate downwardly, as shown in FIG. 14. Piston rod 27, and more particularly the upper end of slot 29, bears against center pivot 82 of linkage mechanism 70 and urges link components 76 and 80 into an expanded, generally aligned condition. Once again, the linkage mechanism eventually crosses the centerline position, wherein the link components are aligned and spring 72 is maximally tensioned. As piston 22 continues to translate in this manner, in the downstroke direction, primary fluid continues to be introduced into upper chamber 32, as indicated by arrow 212, and discharged from lower chamber 34, as indicated by arrow 220. An increasing pressure differential is generated between the upper and lower chambers of the pump body 12.

As piston 22 and attached piston rod 27 continue their downstroke movement, center pivot 82 is eventually pulled downwardly past the centerline position illustrated in FIG. 14. As a result, spring 72 causes link components 76 and 80 to pivot suddenly toward one another, in the manner illustrated in FIG. 15. This collapses overcenter linkage mechanism 70 in a direction opposite to that previously described. Specifically, components 76 and 80 pivot or fold toward one another to form an upwardly facing angle. Attached link components 74 and 78 are pushed generally upwardly, as indicated by arrows 222. Center pivot 82 snaps suddenly into the position shown in FIG. 15 toward the bottom end of slot 29. Link components 76 and 80 engage and are impacted by lower fixed stop members 104 and 106. This transmits an impact force through the linkage mechanism 70 and valve actuator member 48 to valves 36 and 50. As a result, valve seat 42 is jarred loose from pump body shoulder 62 and valve seat 52 is jarred loose from pump body shoulder 66. Valves 36 and 50 are thereby slightly separated from pump body shoulders 62 and 66, respectively, so that the pressure differential between lower chamber 34 and upper chamber 32 is reduced. Once again, this initiates and significantly facilitates the reversal of valves 36 and 50 from the second state, shown in FIGS. 13–15, back into the first state, shown in FIGS. 1, 11 and 12.

After link components 76 and 80 impact stop members 104 and 106, the linkage mechanism continues collapsing until it returns to the condition shown in FIG. 1. Link components 74 and 78 travel upwardly, as shown by arrows 222 in FIG. 15 and this motion drives actuator member 48 and attached valves 36 and 50 in an upward direction. Specifically, valves 36 and 50 are switched from the second state shown in FIG. 13 to the first state shown in FIG. 1. Valve 36 opens orifice 43 to lower chamber 34 and closes orifice 41 to upper chamber 32. Valve 50 opens the orifice 47 and closes orifice 45 to outlet 16. Primary fluid is now introduced into the lower chamber. This causes the pressure to build in the lower chamber, which translates piston 22 and attached piston rod 27 upwardly. The upward movement of the piston pressurizes primary fluid already in upper chamber 32 and forces that fluid through open valve 50 and orifice 47 into discharge outlet 16. The entire sequence is then continuously repeated such that a reciprocating piston drive and continuous pumping is achieved.

By impacting the linkage and facilitating operation of the valves, the stop members permit smaller, less costly springs to be utilized. This, in turn, allows the use of reduced pressure differentials. A far more efficient pump operation is achieved.

In addition to reducing the pressure differential between the upper and lower chambers and facilitating reversal of the valves, fixed stop members 100, 102, 104 and 106 also provide for a failsafe structure that permits pump 10 to continue delivering primary fluid, even in the event spring 72 breaks or otherwise fails. That spring is required for reversing the valves from the first state to the second state and vice versa. Normally, if the tension spring fails, the valves are unable to reverse their states and fluid cannot be delivered from the inlet to the outlet. This may have disastrous consequences for livestock or crops.

Figure 18:
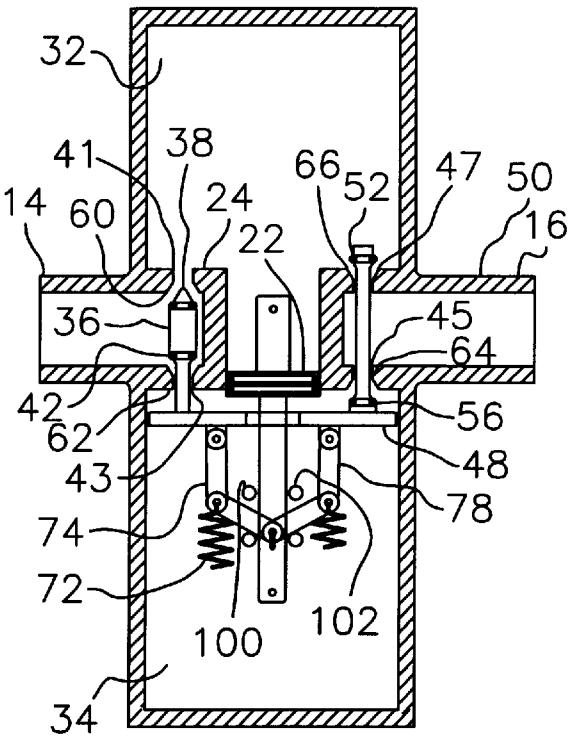
FIG. 18 is a view similar to FIGS. 16 and 17 with the piston in its lowermost position wherein the linkage arms are constrained by the stop members to fully open both valves.
Figure 17:
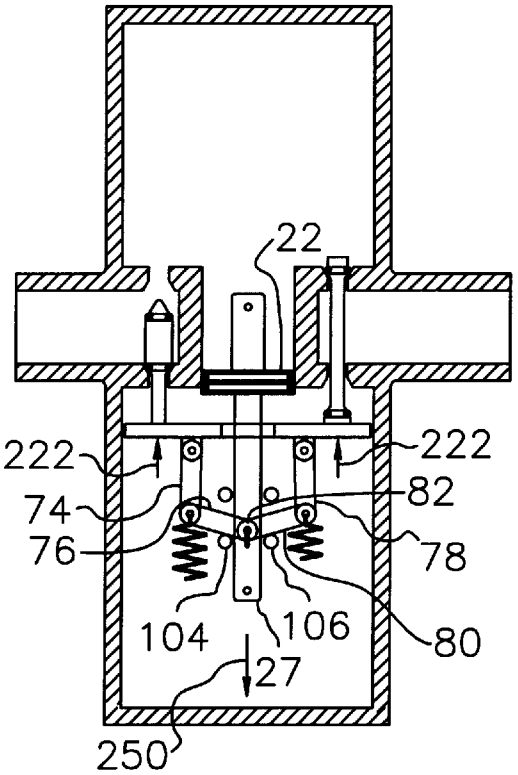
FIG. 17 is a view, similar to FIG. 16 with the piston in a position that causes the linkage arms to impact the stop members.
Figure 16:
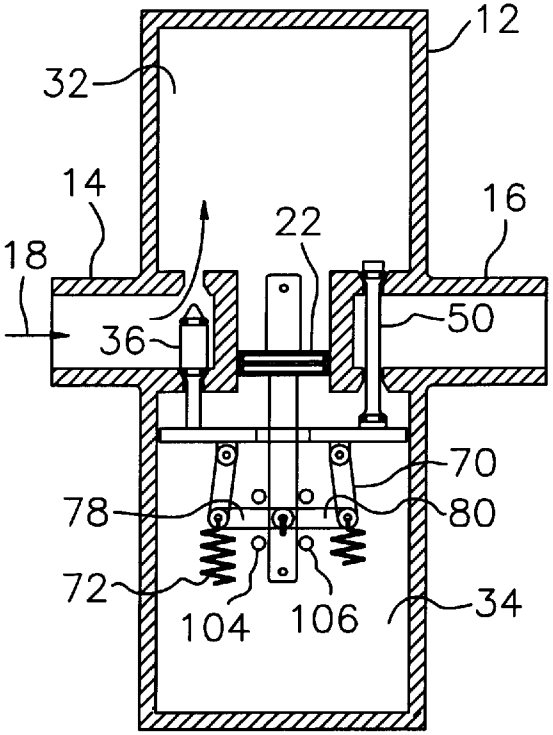
FIG. 16 is an elevational, cross sectional and partly schematic view of the engine with the tension spring in a failed or broken condition and with the linkage mechanism at its centerline position; the piston is on a downward stroke.

The unique fixed stop apparatus described herein permits water to continue flowing through the pump even in the event of spring failure. An example of this failsafe operation is illustrated in FIGS. 16–18. In FIG. 16, the valves are in the above-described second state. Water or other fluid flows in the direction of arrow 18 into inlet 14 and through open valve 36 into upper chamber 32. Prior to spring failure, the piston 22 translates downwardly such that fluid is pumped through lower chamber 34 from open valve 50 into discharge outlet 16. On the particular downstroke illustrated in FIG. 16, spring 72 has broken. Without the presence of stop members 104 and 106, link components 76 and 80 would be unable to pivot together. The linkage mechanism 70 would not collapse and valves 36 and 50 could not be reversed into their first state. Accordingly, no further fluid could be pumped.

Stop members 104 and 106 overcome this problem. After spring 72 breaks, piston 22 continues translating downwardly in the direction of arrow 250, until it reaches its lowermost downstroke position. At that point, operation of the drive piston ceases. During this final downstroke, FIG. 17, piston rod 27 pulls center pivot 82 downwardly in the manner previously described and linkage mechanism 70 strikes fixed stop members 104 and 106. This causes link components 76 and 80 to pivot together sufficiently such that pivotally attached link components 74 and 78 are pushed upwardly in the direction of arrows 222. As shown in FIG. 18, link components 74 and 78 urge valve actuator member 48 upwardly a sufficient distance such that valves 36 and 50 are moved into a third, intermediate state wherein both upper and lower chambers 32 and 34 are open to both inlet 14 and outlet 16. In particular, valve seat 42 is separated from shoulder 62 and valve seat 52 is separated from shoulder 66. At the same time, valve seat 38 remains separated from shoulder 60 and valve seat 56 remains separated from shoulder 64. Each of the orifices 41, 43, 45 and 47 is open. Incoming primary fluid, under pressure, is introduced simultaneously into both upper chamber 32 and lower chamber 34. Primary fluid is also simultaneously discharged from the upper and lower chambers into outlet 16. The stop members constrain linkage 70 and actuator 48 in a position that holds the valves fully open. Fluid is thereby continuously delivered by pump 10 to the use requiring such fluid, even though spring 72 is broken and operation of piston 22 has ceased.

It should be understood that, when spring failure occurs during or immediately prior to a drive piston upstroke, upper stop members 100 and 102 analogously engage link components 76 and 80 to simultaneously open both valves to the upper and lower chambers.

During the above-described operation of the primary fluid pumping assembly, the attached additive fluid pumping assembly operates in the manner shown in FIGS. 19–21. In those illustrations, a reverse view of the additive fluid pumping assembly 110 is depicted.

As drive piston 22 translates upwardly in main body 12, additive fluid piston 118 is drawn upwardly in the direction of arrow 260, FIG. 19. This draws a vacuum in lower section 262 of chamber 116. Additive fluid is thereby drawn upwardly through tube 134 in the direction of arrow 264. The additive fluid enters chamber 116 through check valve 140. During upward translation, check valve 148 is drawn upwardly into sealing engagement with the bottom of piston ring 122. This prevents the fluid previously drawn into chamber 144 from entering the lower section 262 of chamber 116.

Subsequently, during downstroke of the drive piston, additive piston 118 translates downwardly in the direction of arrow 266, through chamber 116 of additive pump body 112. See FIG. 20. Check valve 140 is closed so that the previously drawn additive fluid remains in chamber 116 and is not pushed back into tube 134. The lower end 146 of piston rod 142, it is pushed downwardly through ring 122 so that O-ring check valve 148 is separated from the lower end of ring 122. This provides an open channel through the piston ring. As the piston 118 translates downwardly, the size of chamber segment 262 decreases and the fluid pressure in that segment increases. As a result, fluid is transmitted through the open channel in ring 122 and into the interior cylindrical space 144 disposed about piston rod 142.

Proximate the bottom of the downstroke, surrounding space 144 is positioned primarily within wide diameter portion 117 of chamber 116. As a result, the fluid that has entered through check valve 148 is under relatively low pressure. During the subsequent upstroke, shown in FIG. 21, an increasingly greater portion of piston 118 is drawn into narrow diameter portion 119 of chamber 116. Accordingly, the overall volume of surrounding space 144 decreases and the pressure upon the additive fluid in space 144 increases. Due to this pressure, additive fluid is urged in the direction of arrow 270 through discharge port 130. This fluid is then pumped through conduit 131, FIG. 1, to outlet 16, where it is mixed in a proportioned manner with the primary fluid and delivered with that fluid to the application in need of the fluid mixture.

During the upstroke shown in FIG. 21, additional additive fluid is introduced in the direction of arrow 280 into chamber 116 through open check valve 140. The additive fluid pumping sequence then repeats itself in the above-described manner so that a proportioned amount of additive fluid is continuously introduced into the primary fluid.

It should be understood that both the reciprocating, fluid driven engine and additive pumping assembly of this pump may be constructed utilizing various plastic and metal parts, the precise composition of which will be understood to those skilled in the art. It should also be understood that, although the overcenter linkage mechanism and attached spring are illustrated within the lower chamber of the fluid pump, in alternative embodiments, those components may be positioned equally successfully in the upper chamber. In still other embodiments, the overcenter linkage mechanism and spring means may be placed at various other orientations within the pump. Typically, these components will be arranged symmetrically along the drive piston's longitudinal, translational axis.

It should also be understood that engine 11 may be used to drive various mechanisms other than pumps, including compressors, saws, drills and other devices utilizing a reciprocating engine for driving purposes.

Although specific features of the invention are shown in some drawings and not others, this is for convenience only, as each feature may be combined with any or all of the other features in accordance with the invention. Other embodiments will occur to those skilled in the art and are within the following claims.

What is claimed is:

1. A reciprocating engine, which is driven by a primary fluid, said engine comprising:

a main body having inlet means for receiving said primary fluid and outlet means for discharging said primary fluid;

a drive piston sealingly mounted in said main body for reciprocating movement in response to flow of said primary fluid through said main body and dividing said main body into first and second chambers;

first valve means for selectively transmitting said primary fluid from said inlet into said first and second chambers;

second valve means for selectively transmitting said primary fluid from said first and second chambers to said outlet;

means for operably interconnecting said drive piston and said first and second valve means, including an overcenter linkage mechanism and spring means attached to said linkage mechanism and responsive to reciprocating movement of said drive piston for alternating said first and second valve means between a first state, wherein said first valve means transmits primary fluid from said inlet to just said first chamber and said second valve means transmits primary fluid from said just second chamber to said outlet, and a second state, wherein said first valve means transmits primary fluid from said inlet to just said second chamber and said second valve means transmits primary fluid from said just first chamber to said outlet; and means fixedly mounted to said main body for impacting said overcenter linkage mechanism during movement of said drive piston to initiate and facilitate alternation of said first and second valve means between said first and second states.

2. The device of claim 1 wherein said means for impacting further comprise means responsive to failure of said spring for constraining said overcenter linkage mechanism to hold said first and second valve means in a third, fully open state wherein primary fluid is transmitted through said first valve means from said inlet simultaneously into said first and second chambers and through said second valve means from said first and second chambers simultaneously into said outlet.

3. The device of claim 2 in which said means for impacting and said means for constraining include a first plurality of stop members fixedly mounted within said main body, which impact and constrain said linkage mechanism when said piston reaches a predetermined position in a first direction of reciprocating movement and a second plurality of stop members fixedly mounted within said main body, which impact and constrain said linkage mechanism when said piston reaches a predetermined position in a second direction of reciprocating movement.

4. The device of claim 1 in which said means for operably interconnecting includes a piston rod interconnected between said drive piston and said overcenter linkage mechanism.

5. The device of claim 4 in which said means for operably interconnecting include an actuator member attached to said first and second valve means, said linkage mechanism including a central pivot, a first pair of link components connected together by means defining a first pivot, a like second pair of link components connected together by means defining a second pivot, one component of each said pair being connected to said central pivot and the other component of each said pair being attached to said actuator member.

6. The device of claim 5 in which said piston rod includes a longitudinal slot that slidably received said central pivot of said linkage mechanism.

7. The device of claim 5 in which said means for operably interconnecting include third pivot means for attaching said first pair of link components to said actuator member and fourth pivot means for attaching said second pair of link components to said actuator member.

8. The device of claim 5 in which said spring means is interconnected to and extends between said first and second pivot means of said linkage.

9. The device of claim 8 in which said spring means include at least one resilient O-ring.

10. The device of claim 1 further including an additive pump body attached to said main body and having a third chamber formed therein, a source of additive fluid communicably connected to said additive pump body, conduit means for interconnecting said third chamber with said outlet, and additive piston means slidably mounted in said third chamber, connected to said drive piston and driven by reciprocating movement of said drive piston for pumping additive fluid from said source to said outlet through said conduit means.

11. The device of claim 10 further including means for releasably attaching said additive body to said main body.

12. The device of claim 11 in which said additive pump body is received through and rotatable in an opening in said main body and further including means formed on the periphery of said additive pump body and about said opening of said main body for releasably interlocking said additive pump body and said main body.

13. The device of claim 12 in which said means for releasably interlocking include a first lip portion and a first slotted portion formed about said additive pump body and a complementary second lip portion and second slotted portion formed about said opening, said additive pump body being rotated within said opening to selectively align and interengage said first and second lip portions such that said additive pump body and said main body are interlocked and to selectively align and interengage said first and second lip portions with said second and first slotted portions, respectively, such that said additive pump body is releasable from said main body.

14. The device of claim 13 in which said second lip portion includes means defining a pocket, fluid pressure within said body urging said first lip portion into said pocket when said first and second lip portions are aligned such that rotation of said additive pump body with said main body is limited; said additive pump body being selectively urged against the fluid pressure in said pocket whereby said additive pump body may be rotated within said opening to align said first and second lip portions with said second and first slotted portions, respectively, and release said additive pump body from said main body.

15. A proportioning pump for adding a predetermined volume of additive fluid to a primary fluid, said pump comprising:

a main body having inlet means for receiving said primary fluid and outlet means for discharging said primary fluid;

means for discharging said primary fluid;

a drive piston sealingly mounted in said main body for reciprocating movement in response to flow of said primary fluid through said main body and dividing said main body into first and second chambers;

first valve means for selectively transmitting said primary fluid from said inlet into said first and second chambers;

second valve means for selectively transmitting said primary fluid from said first and second chambers to said outlet;

means for operably interconnecting said drive piston and said first and second valve means, including an overcenter linkage mechanism and spring means attached to said linkage mechanism and responsive to reciprocating movement of said drive piston for alternating said first and second valve means between a first state, wherein said first valve means transmits primary fluid from said inlet to just said first chamber and said second valve means transmits primary fluid from just said second chamber to said outlet, and a second state, wherein said first valve means transmits primary fluid from said inlet to just said second chamber and said second valve means transmits primary fluid from just said first chamber to said outlet;

means fixedly mounted to said main body for impacting said overcenter linkage mechanism during movement of said drive piston to initiate and facilitate alternation of said first and second valve means between said first and second states and responsive to failure of said spring for constraining said overcenter linkage mechanism to hold said first and second valve means in a third, fully open state wherein primary fluid is transmitted through said first valve means from said inlet simultaneously into said first and second chambers and through said second valve means from said first and second chambers simultaneously into said outlet;

a additive pump body attached to said main body and having a third chamber formed therein;

a source of additive fluid communicably connected to said additive pump body;

conduit means for interconnecting said third chamber with said outlet; and additive piston means slidably mounted in said third chamber, connected to said drive piston and driven by reciprocating movement of said drive piston for pumping additive fluid from said source to said outlet through said conduit means.

* * * * *